US008101910B2

(12) United States Patent
Loboda

(10) Patent No.: US 8,101,910 B2
(45) Date of Patent: Jan. 24, 2012

(54) METHOD, SYSTEM AND APPARATUS FOR MULTIPLEXING IONS IN MS$^n$ MASS SPECTROMETRY ANALYSIS

(75) Inventor: Alexandre Loboda, Thornhill (CA)

(73) Assignee: DH Technologies Development PTE. Ltd., Singapore (SG)

( * ) Notice: Subject to any disclaimer, the term of this patent is extended or adjusted under 35 U.S.C. 154(b) by 66 days.

(21) Appl. No.: 12/569,357

(22) Filed: Sep. 29, 2009

(65) Prior Publication Data

US 2010/0078551 A1 Apr. 1, 2010

Related U.S. Application Data

(60) Provisional application No. 61/101,862, filed on Oct. 1, 2008.

(51) Int. Cl.
*H01J 49/42* (2006.01)

(52) U.S. Cl. ..... 250/292; 250/281; 250/282

(58) Field of Classification Search ..... 250/292, 250/287, 281, 282

See application file for complete search history.

(56) References Cited

U.S. PATENT DOCUMENTS

| | | | | |
|---|---|---|---|---|
| 5,381,006 | A | 1/1995 | Wells et al. | |
| 6,011,259 | A | 1/2000 | Whitehouse et al. | |
| 6,177,668 | B1 | 1/2001 | Hager | |
| 6,483,109 | B1 | 11/2002 | Reinhold et al. | |
| 6,700,120 | B2 | 3/2004 | Hager | |
| 6,770,871 | B1 | 8/2004 | Wang et al. | |
| 7,041,968 | B2 | 5/2006 | Enke | |
| 7,084,398 | B2 | 8/2006 | Loboda et al. | |
| 7,189,967 | B1 * | 3/2007 | Whitehouse et al. | 250/292 |
| 7,196,324 | B2 | 3/2007 | Verentchikov | |
| 2004/0124354 | A1 | 7/2004 | Bateman et al. | |
| 2006/0289744 | A1 | 12/2006 | Jolliffe et al. | |
| 2007/0034810 | A1 | 2/2007 | Hoyes | |
| 2007/0120053 | A1 | 5/2007 | Loboda | |

FOREIGN PATENT DOCUMENTS

| | | |
|---|---|---|
| WO | 03 094197 | 11/2003 |

OTHER PUBLICATIONS

"International Search Report" for PCT/CA2009/001369, International Searching Authority/CA, Jan. 5, 2010, pp. 1-4, Canadian Intellectual Property Office, Quebec, Canada.

* cited by examiner

*Primary Examiner* — Kiet Nguyen

(74) *Attorney, Agent, or Firm* — Kurt Rauschenbach; Rauschenbach Patent Law Group, LLP

(57) ABSTRACT

A method and apparatus for multiplexing ions in an MSn mass spectrometer is provided. Ion are filtered to produce a group of ions of interest, the group of ions below a space charge limit of the MSn mass spectrometer. At least a portion of the group of ions are fragmented to form a fragmented group of ions. At least a portion of the fragmented group are stored such that a plurality of portions of the fragmented group can be sequentially selected for mass spectrometry analysis. Each of the plurality of portions of the fragmented group are sequentially selected and re-fragmented prior to mass spectrometry analysis. Each of the plurality of portions of the fragmented group are analyzed, via mass spectrometry, once each of the plurality of portions of the fragmented group has been fragmented.

23 Claims, 15 Drawing Sheets

METHOD, SYSTEM AND APPARATUS FOR MULTIPLEXING IONS IN MS$^n$ MASS SPECTROMETRY ANALYSIS

RELATED APPLICATION SECTION

This application claims priority to U.S. Provisional Patent Application Ser. No. 61/101,862, filed Oct. 1, 2008, the entire application of which is incorporated herein by reference.

FIELD

The specification relates generally to mass spectrometry, and specifically to a method and apparatus for multiplexing ions in MS$^n$ mass spectrometry analysis.

INTRODUCTION

MS$^n$ (or MSn) is a mass spectrometry technique that extracts structural/quantitative information based on multi level fragmentation pathways for compounds of interest. MSn is generally performed as follows: a mass spectral region containing ions of interest is selected and the rest of the ions are filtered out; remaining ions of interest are fragmented; one fragment of interest is selected while the rest of the ions are filtered out; the fragment of interest is fragmented and the spectrum of secondary fragments and/or intensity of a particular secondary fragment is recorded. The sequence (filter-fragment) can continue on to obtain further generation fragments with each level of fragmentation potentially providing new information related to the structure of the ion. However, high level MSn analysis is rarely practiced as each step of filtering leads to reduction of ion current typically by a factor of 10 to 100, resulting in low sensitivity. While MS-MS and MSn multiplexing can improve ion utilization, successive fragmentation of ions with multiplexing leads to a longer analysis cycle and an increase in space charge of primary ions. If the space charge limit of the mass spectrometer is exceeded it will lead to inaccurate results. Hence, in this approach, the primary ion current has to be attenuated in order to control the space charge, resulting in the loss of the instrument efficiency through reduction of the ion signal.

BRIEF DESCRIPTIONS OF THE DRAWINGS

The skilled person in the art will understand that the drawings, described below, are for illustration purposes only. The drawings are not intended to limit the scope of the applicant's teachings in any way.

DETAILED DESCRIPTION OF VARIOUS EMBODIMENTS

Figure 1:
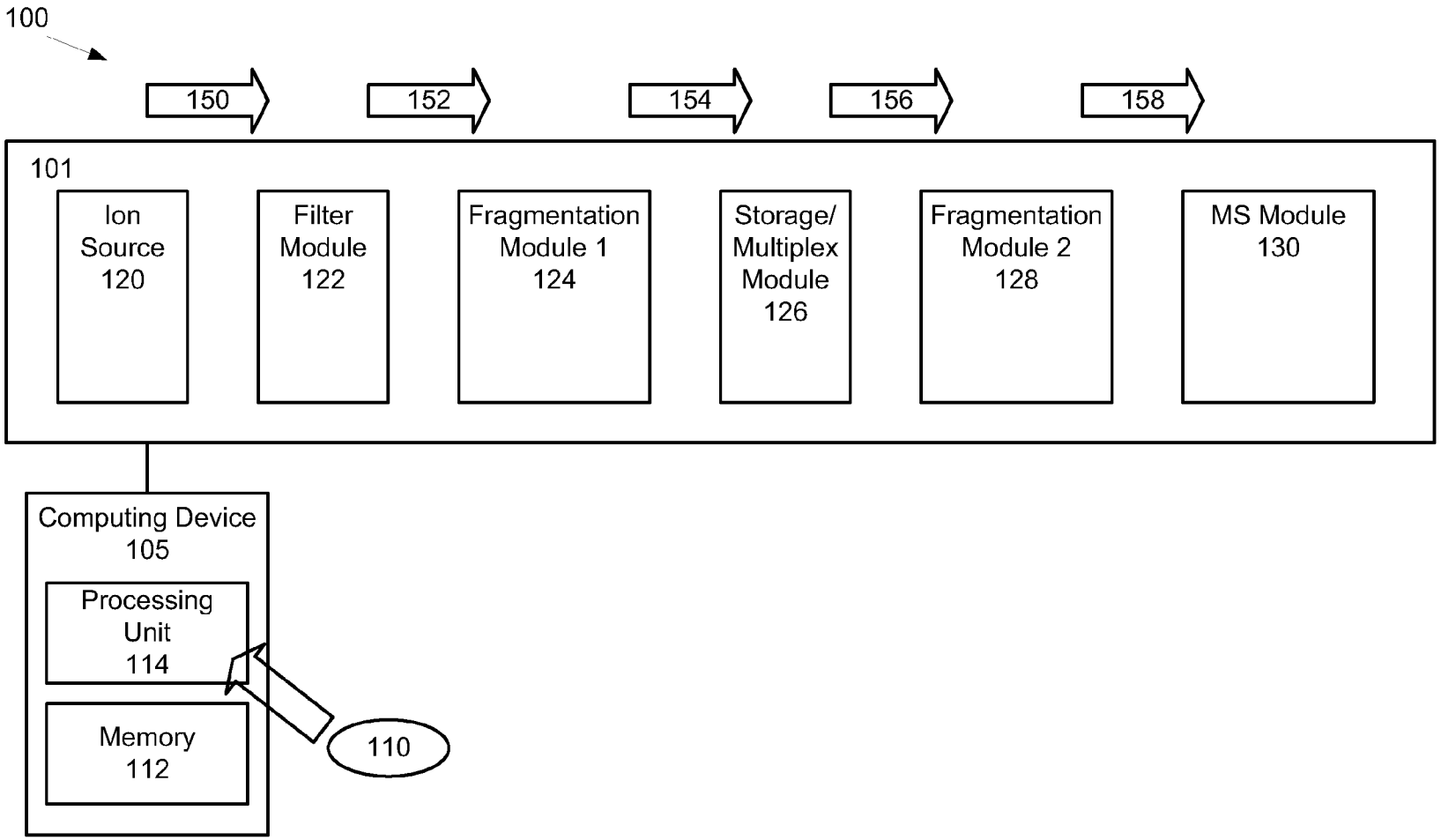
FIG. 1 depicts a system for multiplexing ions in MSn mass spectrometry analysis, according to non-limiting embodiments.

A first aspect of the specification provides a method for multiplexing ions in an MSn mass spectrometer. The method comprises filtering ions to produce a group of ions of interest, the group of ions below a space charge limit of the MSn mass spectrometer. The method further comprises fragmenting at least a portion of the group of ions to form a fragmented group of ions. The method further comprises storing at least a portion of the fragmented group such that a plurality of portions of the fragmented group can be sequentially selected for mass spectrometry analysis. The method further comprises sequentially selecting and re-fragmenting each of the plurality of portions of the fragmented group prior to the mass spectrometry analysis. The method further comprises analyzing, via mass spectrometry, each of the plurality of portions of the fragmented group once each of the plurality of portions of the fragmented group has been fragmented. The method can further comprise repeating the storing step and the sequentially selecting and re-fragmenting step a given number of times for each of the plurality of portions of the fragmented group prior to the analyzing step, such that at least a subset of each of the plurality of portions of the fragmented group is re-fragmented the given number of times. The storing step can comprise causing the fragmented group to travel back along an ion path of the MSn mass spectrometer.

The sequentially selecting and re-fragmenting steps can comprise causing at least a subset of each of the plurality of portions of the ions to travel back and forth along an ion path of the mass spectrometer.

The sequentially selecting and re-fragmenting steps can comprise selectively transferring at least a subset of each of the plurality of portions of the fragmented group through the MSn mass spectrometer, wherein the selective transferring can comprise selecting a given mass range of each of the plurality of portions of the fragmented group.

Filtering ions to produce a group of ions of interest can comprise filtering the ions based on a given mass range of the ions.

A second aspect of the specification provides a multiplexing MSn mass spectrometer. The multiplexing MSn mass spectrometer comprises an ion source for producing ions. The multiplexing MSn mass spectrometer further comprises a filter module, connected to the ion source, for filtering the ions to produce a group of ions of interest, the group of ions below a space charge limit of the MSn mass spectrometer. The multiplexing MSn mass spectrometer further comprises a storage module, connected to the filter module, for storing at least the group of ions of interest, the at least one storage module further enabled to sequentially select a plurality of portions of at least the group of ions of interest for fragmentation and mass spectrometry analysis. The multiplexing MSn mass spectrometer further comprises a fragmentation module, connected to the storage module, for fragmenting ions which have been sequentially selected at the at least one storage module. The multiplexing MSn mass spectrometer further comprises a mass spectrometry analysis module, connected to the fragmentation module, for analyzing fragmented ions, via mass spectrometry.

The storage module and the fragmentation module can be enabled to transfer at least a subset of each of the plurality of portions back and forth between each of the storage module and the fragmentation module a given number of times such that at least each subset is fragmented the given number of times prior to analysis by the mass spectrometry analysis module. Transfer of at least each subset from the fragmentation module to the storage module can occur non-selectively, and transfer of at least each subset from the storage module to the fragmentation module can occur selectively. The storage module can be further enabled for the group of ions of interest to pass there-through to the fragmentation module. The at least one storage module can comprise the filtering module. The multiplexing MSn mass spectrometer can further comprise a second storage module located between the ion source and the storage module, the second storage module enabled for ion storage and sequential selection of a plurality of portions of a group of ions stored therein for fragmentation and mass spectrometry analysis. The second storage module can be further enabled to allow ions from the ion source to pass there-through to the storage module. The second storage module and the storage module can be enabled to transfer ions stored in the storage module to the second storage module.

The fragmentation module can be further enabled to store the fragmented ions.

The at least one of the storage module and the fragmentation module can be enabled to discard a remaining portion of ions located therein.

The multiplexing MSn mass spectrometer can further comprise a second fragmentation module located between the storage module and the second fragmentation module for fragmenting the group of ions of interest prior to storing the group of ions of interest in the storage module.

The multiplexing MSn mass spectrometer can further comprise a given number of through/storage modules located between the second fragmentation module and the storage module, each through/storage module enabled to store a given generation of fragmented ions, and each through/storage module enabled for non-selective transfer of ions there-through to the storage module, and further enabled for non-selective transfer of ions from the storage module to the second fragmentation chamber.

The ion source can comprise at least one of an electro-spray ion source, a nano-spray ion source, an APCI (atmospheric pressure chemical ionization) ion source, an APPI (atmospheric pressure photoionization) ion source, an electron impact ion source, a MALDI (matrix assisted laser desorption ionization) ion source and a SIMS (secondary ion mass spectrometry) ion source.

The fragmentation module can comprise at least one of collision induced dissociation (CID), surface induced dissociation (SID), electron capture dissociation (ECD), electron transfer dissociation (ETD), metastable-atom bombardment, and photo-fragmentation.

The storage module can comprise at least one of a linear ion trap, an array of linear ion traps, an array of 3D ion traps, a Penning trap, a quadrupole ion trap, a cylindrical ion trap, an ion trap with axial ejection, an ion trap with radial ejection, a Time-of-Flight separation system and a mobility separation ion trap.

The mass spectrometry analysis module can comprise at least one of a sector field mass analyzer, a time of flight analyzer, a quadrupole mass analyzer, an ion trap, a quadrupole ion trap, a linear quadrupole ion trap, a quadrupole mass filter, a TOF (time of flight) analyzer, and a FT-MS (Fourier transform mass spectrometry mass) analyzer.

The filter module can comprise at least one of a quadrupole mass filter, a magnetic sector mass filter, an ion mobility filter, and an ion trap mass filter.

FIG. 1 depicts a system 100 for multiplexing ions in MSn mass spectrometry analysis, according to non-limiting embodiments, the system 100 comprising a multiplexing MSn mass spectrometer 101 in communication with a computing device 105. In general the computing device 105 controls the operation of the mass spectrometer 101 by processing an application 110 that can be stored in a memory 112 of the computing device 105 and processed by a processing unit 114 of the computing device 105. The computing device 105 transmits control signals to each element of the mass spectrometer 101, as appropriate, to control the operation of the mass spectrometer 101, for example via interfaces and a computer bus structure in each of the computing device 105 and the mass spectrometer 101. Indeed, it is understood in the following description that each of the elements of the mass spectrometer 101 are enabled to accept control signals and respond accordingly such that their operation can be controlled. In some non-limiting embodiments, the mass spectrometer 101 comprises the computing device 105.

In non-limiting embodiments, the mass spectrometer 101 comprises an ion source 120 connected to a filter module 122. The ion source 120 is enabled to produce ions for mass spectrometry analysis, for example by ionizing a sample introduced into the ion source 120, to produce a group of ions. Further, the ion source 120 is generally enabled to transmit the group of ions to the filter module 122. The ion source 120 can include any suitable ion source technology including, but not limited to, an electro-spray ion source, a nano-spray ion source, APCI (atmospheric pressure chemical ionization), APPI (atmospheric pressure photoionization), or an electron impact ion source (including but not limited to pulsed ion sources such as MALDI (matrix assisted laser desorption ionization) and SIMS (secondary ion mass spectrometry)). However, other types of ion source technology will occur to persons of skill in the art and are within the scope of present embodiments.

The filter module 122 is enabled to accept ions from the ion source 120 and filter ions in at least one of space, time, and energy in order to generally select a mass range of the ions for mass spectrometry analysis and/or reduce the total space charge of the ions below a space charge limit of fragmentation and/or storage modules etc. of the mass spectrometer 101, described hereafter. The filter module 122 can include any suitable mass filter including, but not limited to, a quadrupole mass filter, an ion-trap based mass filter, a TOF (time of flight) based mass filter, or a magnetic sector mass filter. However, other types of mass filters will occur to persons of skill in the art and are within the scope of present embodiments. Indeed, by filtering ions from the ion source 120 to generally select a mass range of interest, and reduce the space charge, a step of attenuation of the primary ion beam (i.e. ions produced by the ion source 120) is eliminated, and the efficiency of the mass spectrometer 101 is increased. Furthermore, this targeted reduction of space charge impacts the quality of mass spectra recorded at the mass spectrometry module 130, described below. In other words, filtering occurs to address space charge limitations in the mass spectrometer 101, and the net result is fewer ions in the mass spectrometer 101 such that space charge does not overwhelm any of the other modules of the mass spectrometer, as described below. Further by choosing the mass range of interest prior to any fragmentation and analysis, the subsequent information which is extracted from the filtered ions can be more detailed than in instances where no filtering occurs.

The mass spectrometer 101 further comprises a first fragmentation module 124 connected to the filter module 122, the first fragmentation module 124 enabled to accept ions from the filter module 122 and fragment the ion using any suitable fragmentation technology including, but not limited to, collision induced dissociation (CID), surface induced dissociation (SID), electron capture dissociation (ECD), electron transfer dissociation (ETD), metastable-atom bombardment, photo-fragmentation. However, other types of fragmentation technologies will occur to persons of skill in the art and are within the scope of present embodiments. In embodiments where fragmentation occurs via collision with a gas, the first fragmentation module 124 can comprise an input for a gas for effecting fragmentation of ions.

The mass spectrometer 101 further comprises a storage/multiplex module 126 connected to the first fragmentation module 124, the storage/multiplex module 126 enabled to accept fragmented ions from the first fragmentation module 124 and store the fragmented ions. The storage/multiplex module 126 can include any suitable ion storage technology, including but not limited to linear ion traps, arrays of linear ion traps, arrays of 3D ion traps, Penning traps, quadrupole ion traps, and/or cylindrical ion traps. However, other types of ions storage technologies will occur to persons of skill in the art and are within the scope of present embodiments. The storage/multiplex module 126 is further enabled for sequential selection and transfer of a plurality of portions of fragmented ions stored in the storage/multiplex module 126 for mass spectrometry analysis, in other modules described below, while a remaining portion remains stored within the storage/multiplex module 126. Sequential selection and transfer of selected portions for further analysis is also known as multiplexing. The multiplexing setup can include, but is not limited to, an ion trap with axial ejection, an ion trap with radial ejection, Time-of-Flight separation system, and/or a mobility separation. However, other types of multiplexing technologies will occur to persons of skill in the art and are within the scope of present embodiments.

The mass spectrometer 101 further comprises a second fragmentation module 128 connected to the storage/multiplex module 126, the second fragmentation module 128 can be substantially similar in function to the first fragmentation module 124, described above. The second fragmentation module 128 is enabled to accept each of the plurality of portions of fragmented ions when sequentially selected and transferred from the storage/multiplex module 126, and fragment each of the plurality of portions of fragmented ions for mass spectrometry analysis.

The mass spectrometer 101 further comprises a mass spectrometry analysis module 130 connected to the second fragmentation module 128. The mass spectrometry analysis module 130 is enabled to perform mass spectrometry analysis on each of the plurality of portions of fragmented ions once they are fragmented in the second fragmentation module 128. The mass spectrometry module 130 is further enabled to output mass spectrometry data to the computing device 105 for analysis and storage. The mass spectrometry analysis module 130 can include any suitable mass spectrometry technology including, but not limited to, mass analyzers such as ion traps, quadrupole mass filters, TOF analyzers, FT-MS (Fourier transform mass spectrometry mass) analyzers, sector field mass analyzers, quadrupole mass analyzers, quadrupole ion traps, and linear quadrupole ion traps. However, other types of mass spectrometry technology will occur to persons of skill in the art and are within the scope of present embodiments.

Each of the elements of the mass spectrometer 101 are generally interconnected such that ions produced at the ion source 120 can be transferred to the filter module 122 for filtering (as represented by arrow 150), ions from the filter module 122 can be transferred to the first fragmentation module 124 for fragmentation (as represented by arrow 152), and fragmented ions from the first fragmentation module 124 can be transferred to the storage/multiplex module 126 for storage (as represented by arrow 154). Portions of the fragmented ions can then be sequentially selected and transferred to the second fragmentation module 128 for fragmentation (as represented by arrow 156) and then transferred to the mass spectrometry module 130 for mass spectrometry analysis (as represented by arrow 158). In general, MS analysis performed on ions fragmented in the first fragmentation module 124 (i.e. without subsequent fragmentation in the second fragmentation module 128) comprises MS-MS ($MS^2$) analysis. MS analysis performed on ions fragmented in the second fragmentation module 128 (i.e. after a first fragmentation in the first fragmentation module 124 comprises $MS^3$ analysis.

Once each portion of the fragmented ions is selected and transferred to the second fragmentation chamber 128, the remaining portion of the fragmented ions remains stored in the storage/multiplex module 126 such that further portions of the fragmented ions can be selected, in sequence, for fragmentation and mass spectrometry analysis. Each portion which is sequentially selected by the storage/multiplex module 126 can be in the same mass range or a different mass range of the other portions. Further, each portion that is selected can have a size suitable for providing a desired sensitivity in the mass spectrometry analysis. Further, in some embodiments, there is no filtering of the entire group of fragmented ions during each subsequent fragmentation step, and hence there is no undue loss of ion current. In other embodiments, there can be limited filtering of the entire group of fragmented ions during each subsequent fragmentation step (for example to select a subset of the entire group of fragmented ions that is a substantial portion of the entire group) and hence no significant loss of ion current. In yet further embodiments there can be a substantial filtering of fragmented ions, for example to select a subset of the entire group of fragmented ions that is a limited portion of the entire group, hence selecting a limited number of components for analysis. The latter embodiments generally reduce the total analysis time by reducing the number of analysis steps, but still allow for a plurality of components to be selected for analysis.

In some embodiments, ions can be gated between the ion source 120 and the filter module 122. In other embodiments, ions can be gated between the filter module 122 and the first fragmentation module 124. Such gating generally prevents contamination of the storage/multiplex module 126 with incoming $MS^2$ ions (i.e. ions from the ion source and/or further ions that are being fragmented in the first fragmentation module 124 after a first group of fragmented ions have being transferred to the storage/multiplex module 126).

It is furthermore understood that the mass spectrometer 101 can comprise any number of additional elements for enabling transfer of ions through the mass spectrometer 101 including, but not limited to, vacuum pumps, vacuum connectors, power supplies, electrical connectors, electrodes etc.

In yet further embodiments, the mass spectrometer 101 can comprise further pairs of storage/multiplex and fragmentation modules located between the second fragmentation module 128 and the mass spectrometry module 130, such that if the mass spectrometer 101 comprises N fragmentation chambers, $MS^{N+1}$ analysis can be performed.

Figure 2:
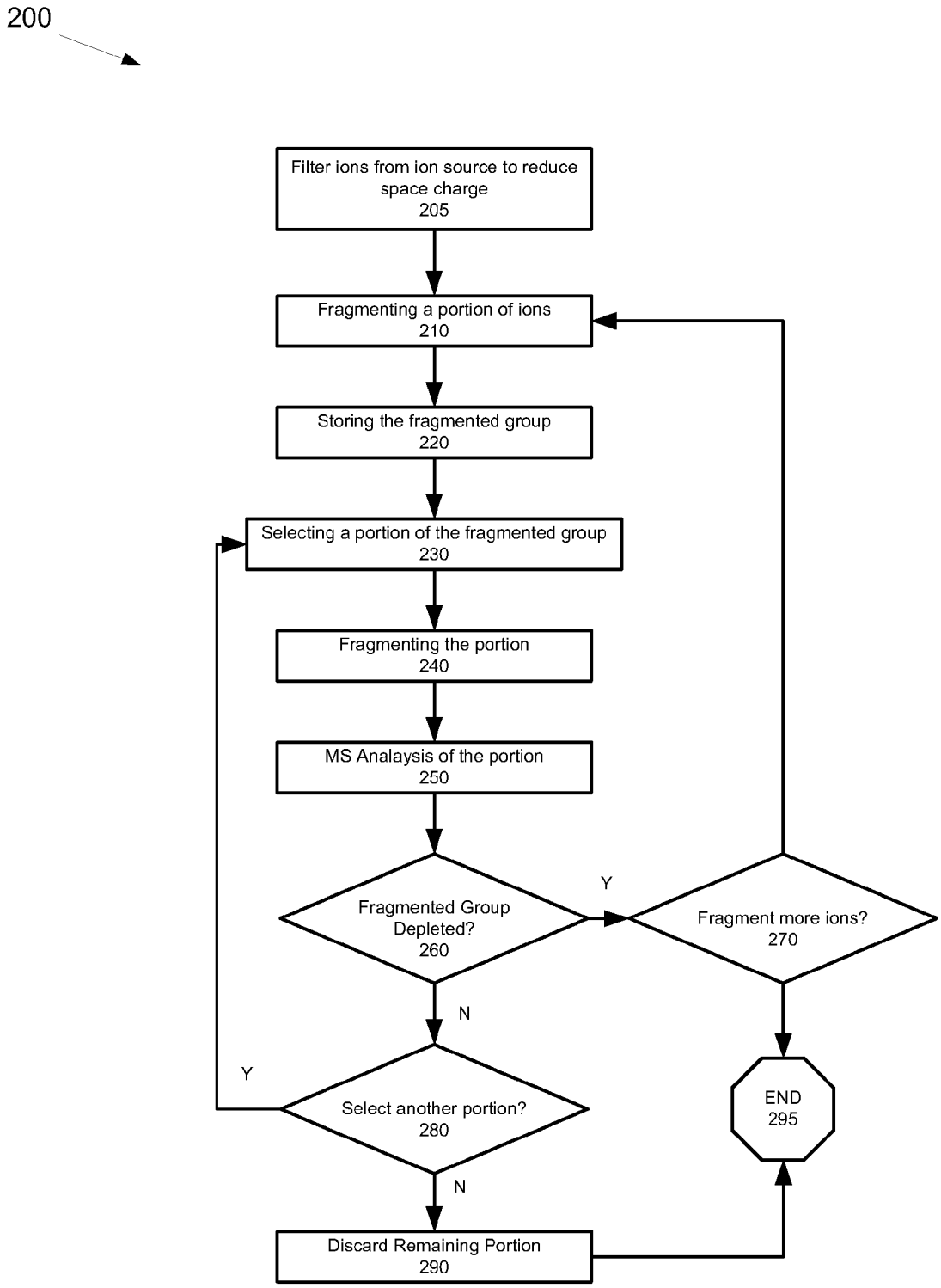
FIG. 2 depicts a method for multiplexing ions in MSn mass spectrometry analysis, according to non-limiting embodiments.

Attention is now directed to FIG. 2 which depicts a method 200 for multiplexing ions in MSn mass spectrometry analysis. In order to assist in the explanation of the method 200, it will be assumed that the method 200 is performed using the system 100. Furthermore, the following discussion of the method 200 will lead to a further understanding of the system 100 and its various components. In particular, it is understood that the method 200 can be performed using the system 100 when the application 110 is processed by the processing unit 114. However, it is to be understood that the system 100 and/or the method 200 can be varied, and need not work exactly as discussed herein in conjunction with each other, and that such variations are within the scope of present embodiments.

It is assumed in the method 200 that a suitable sample has been introduced into the ion source 120, and that the suitable sample has been ionised by the ion source 120 to produce ions for analysis.

Figure 3:
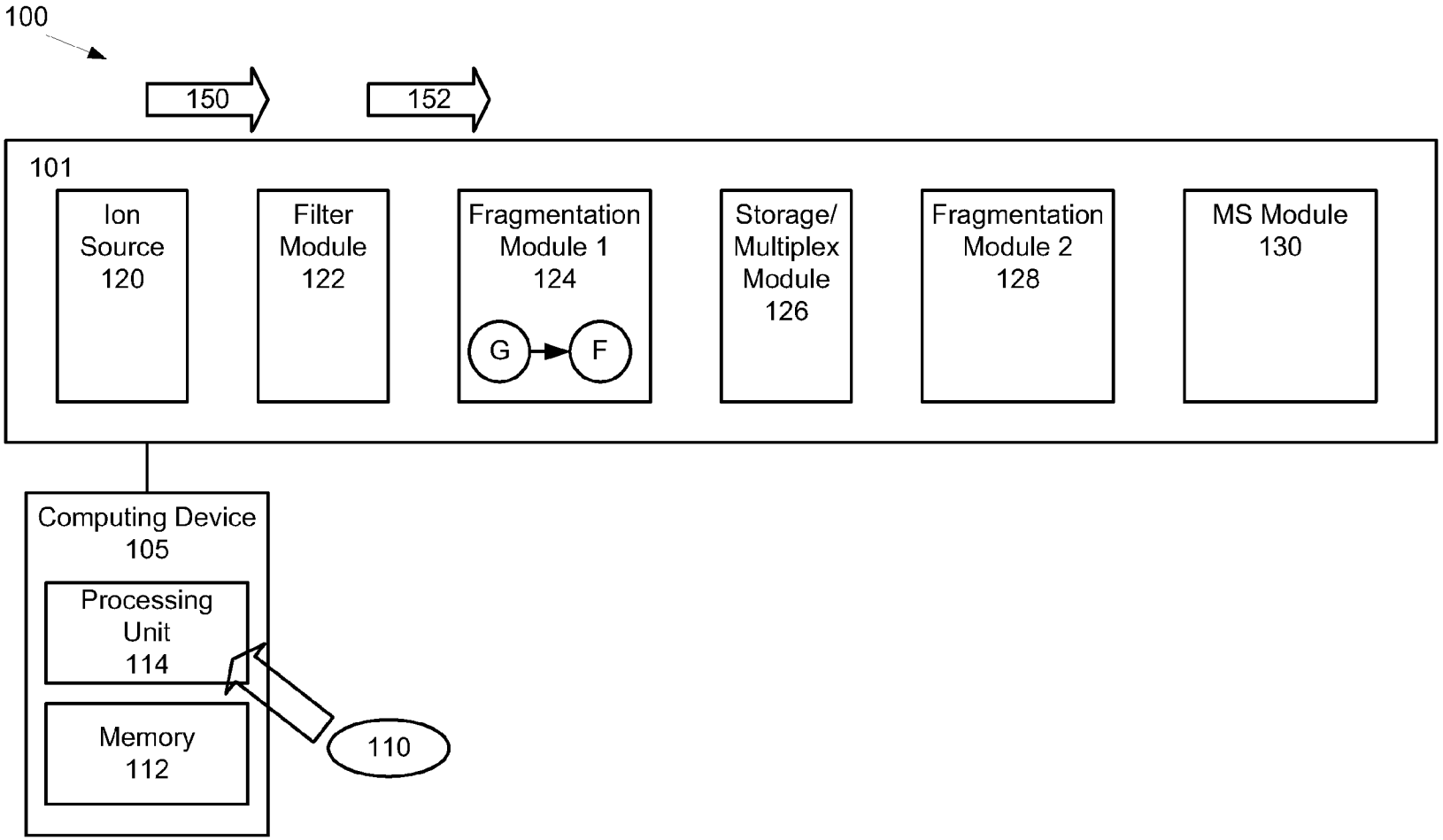
FIGS. 3 to 6 depict the system of FIG. 1 in operation, according to non-limiting embodiments.

At step 205, the ions from the ion source are filtered via the filter module 122 to produce a group of ions of interest G, as depicted in FIG. 3 (which is substantially similar to FIG. 1, with like elements having like numbers). In general the ions are filtered my mass selection, and the group of ions G are of a mass range of interest. By filtering the ions prior to performing fragmentation steps (see below), the space charge within the mass spectrometer 101 is reduced to below a space charge limit of the mass spectrometer 101 (e.g. of the subsequent modules in the mass spectrometer 101). Hence, the impact of the space charge is reduced with respect to instances where no filtering occurs.

Step 205 further comprises transferring the group of ions G to the first fragmentation module 124 for fragmentation (arrow 152).

Figure 4:
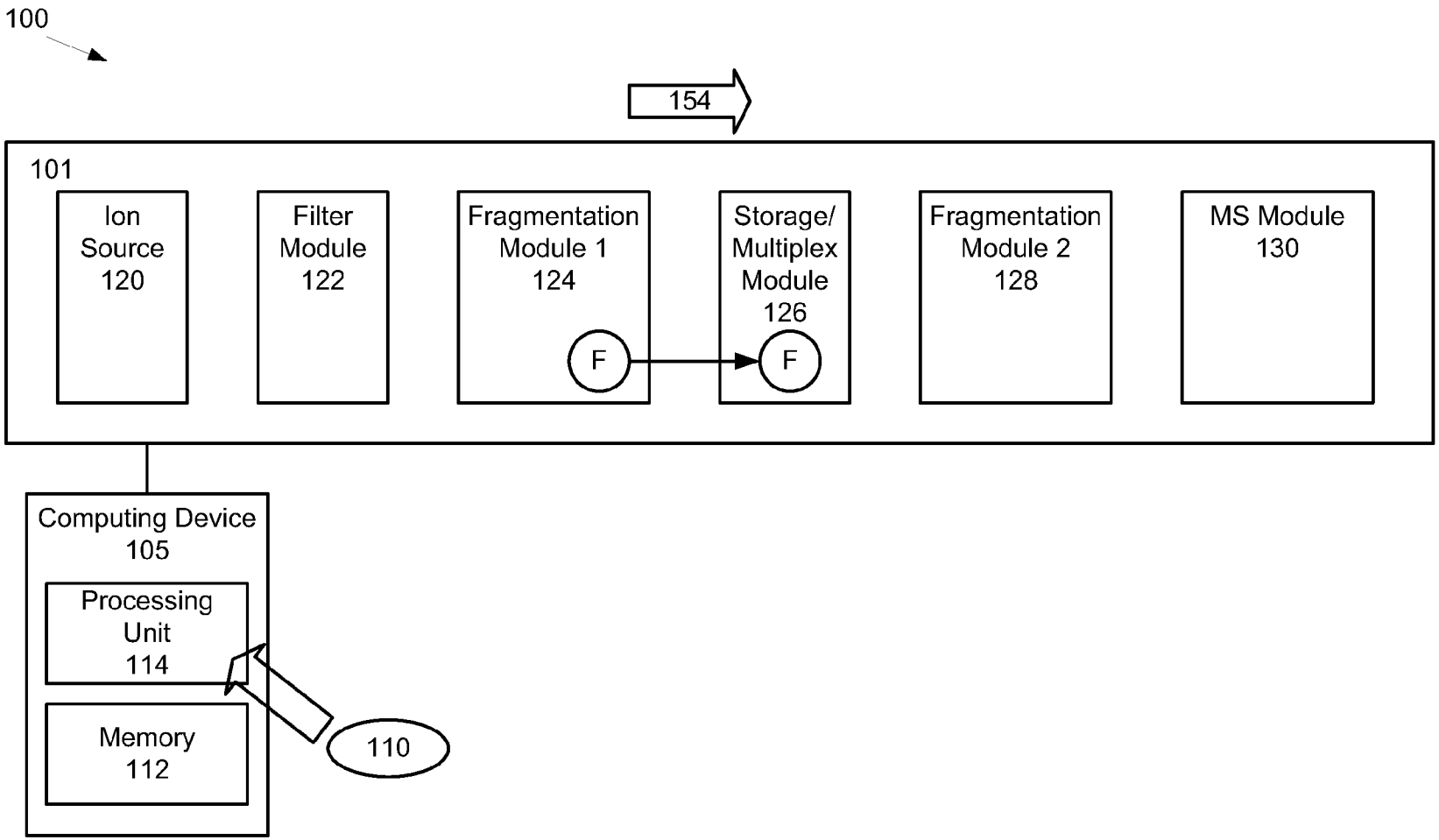

At step 210 at least a portion of the group of ions G is fragmented to form a fragmented group of ions F, as depicted in FIG. 3. For example the group of ions G can be fragmented by the first fragmentation module 124 to form the fragmented group of ions F. The fragmented group of ions F is then transferred (arrow 154) to the storage/multiplex module 126, as depicted in FIG. 4, which is substantially similar to FIG. 1, with like elements having like numbers.

At step 220 the fragmented group F is stored such that a plurality of portions of the fragmented group F can be sequentially selected for mass spectrometry analysis. For example, the fragmented group F is generally stored in the storage/multiplex module 126 via any suitable ion storing technique (e.g. via an ion trap, etc., as described above), as depicted in FIG. 4.

Figure 5:
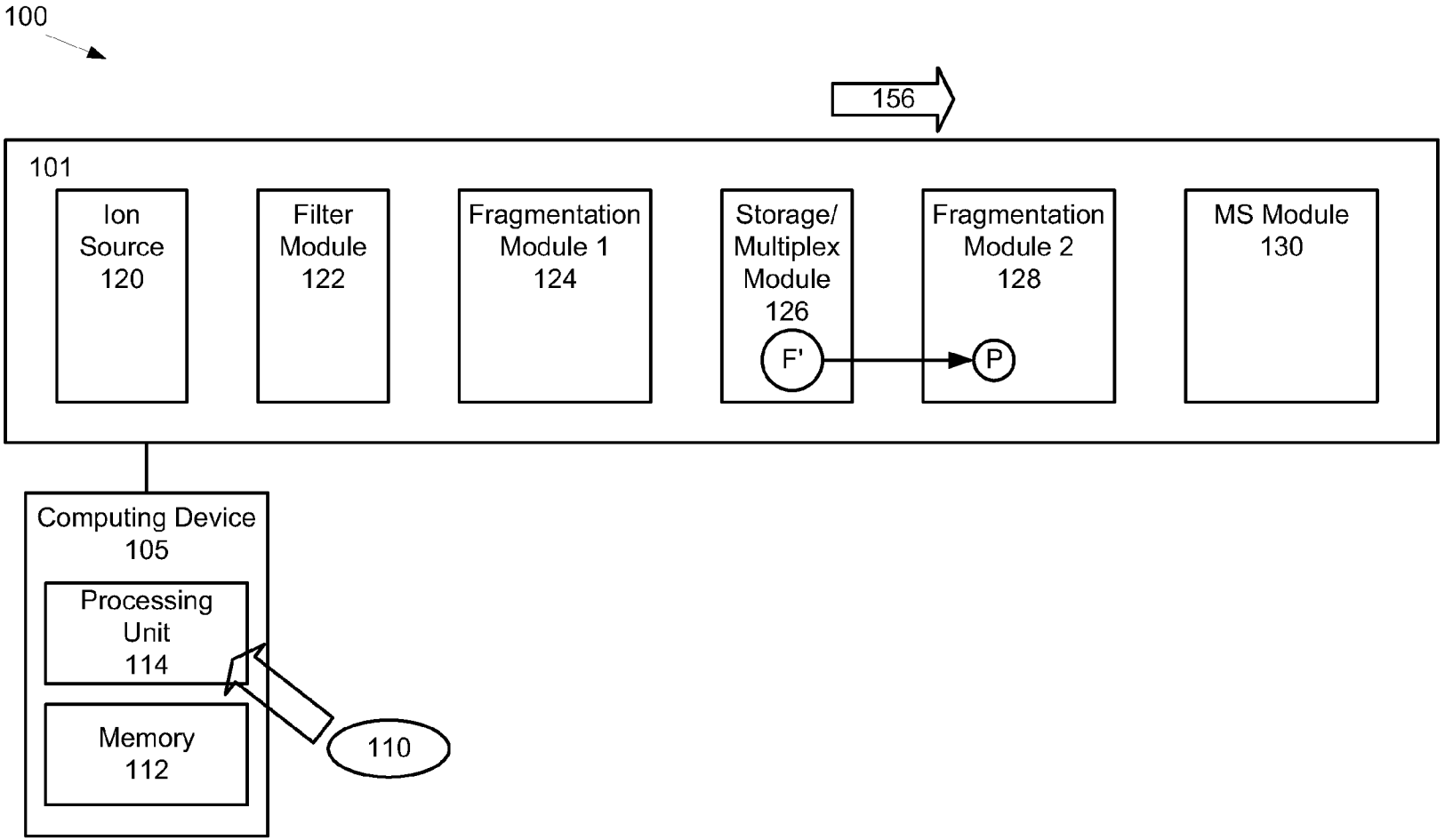

At step 230 a portion P of the fragmented group F is selected for mass spectrometry analysis and selectively transferred (arrow 156) to the second fragmentation module 128, as depicted in FIG. 5 (which is substantially similar to FIG. 1, with like elements having like numbers). For example, as the storage/multiplex module 126 is generally enabled for mass selective transfer of ions to the second fragmentation module 128, the portion P can be of any desired/suitable mass range of the fragmented group F. Further, the fragmented group F is then reduced by an amount P, leaving behind a remaining portion F' of the fragmented ions F, as depicted in FIG. 5. In some embodiments, at this stage, mass spectrometry analysis ($MS^2$) can be performed on the portion P by transferring the portion P to the mass spectrometry module 130.

Figure 6:
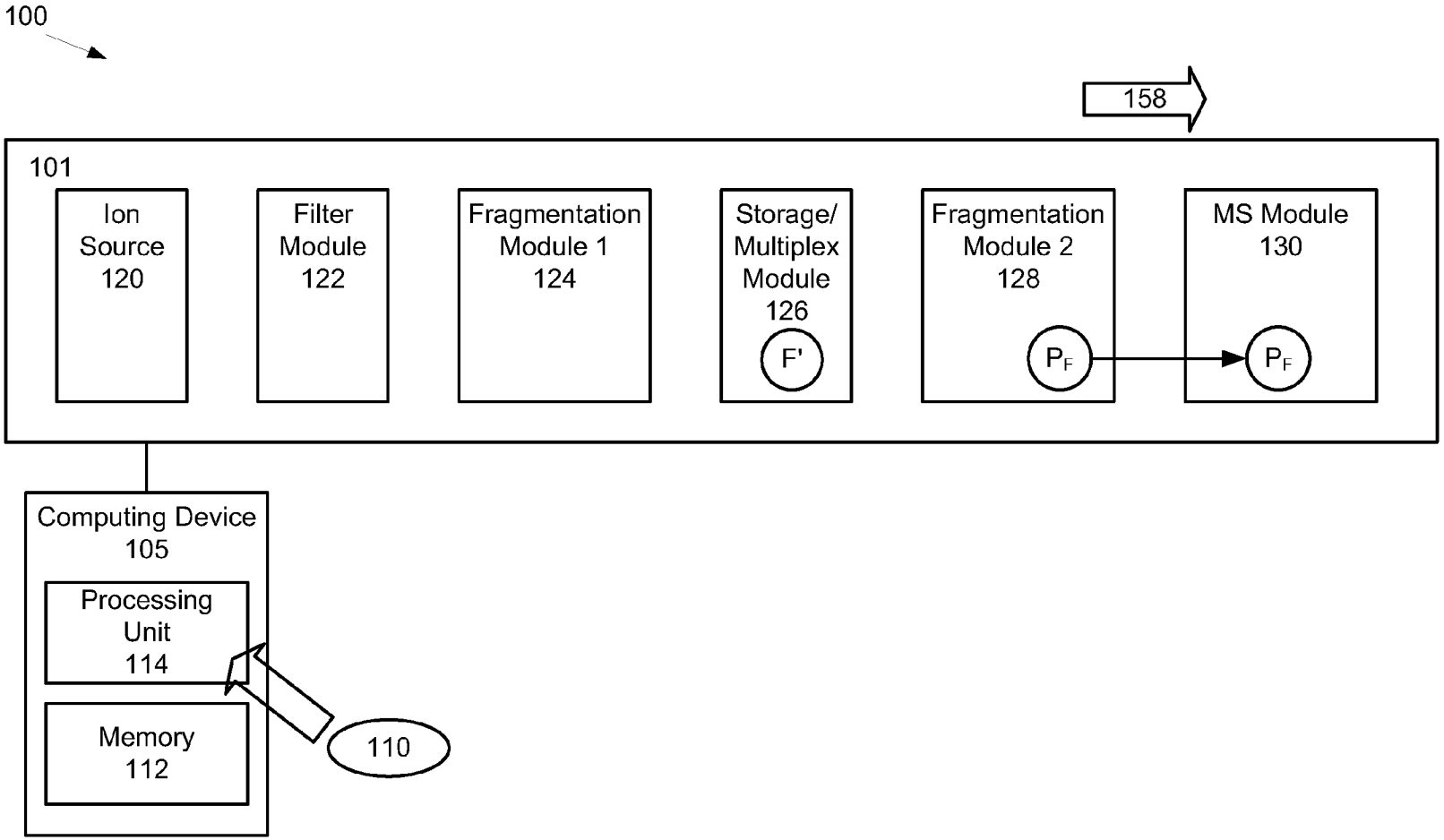

However, if $MS^3$ is desired, at step 240, the portion P is fragmented in the second fragmentation chamber 128, to produce a fragmented portion $P_F$, and at step 250 the fragmented portion $P_F$ is transferred (arrow 158) to the mass spectrometry module 130 for mass spectrometry analysis, subsequently producing mass spectrometry data that is transferred to the computing device 110 for analysis and storage. Steps 240 and 250 are depicted in FIG. 6, which is substantially similar to FIG. 1, with like elements having like numbers.

At step 260, it is determined if the fragmented group F (e.g. the remaining portion F') stored in the storage/multiplex module 126 is depleted. If not, at step 280 it is determined if another portion of the fragmented group F (e.g. a portion of the remaining portion F') is to be selected in sequence for mass spectrometry analysis. If so, steps 230 through 260 are repeated with another portion of the fragmented group F. For example, the application 110 can be configured to cause a given number of portions of the fragmented group F to undergo mass spectrometry analysis. If the number of portions that have been sequentially selected is below or equal to the given number, steps 230 through 260 are repeated. If not, the number of portions that have been sequentially selected is greater than the given number, then at step 290 the remaining portion F' is discarded, for example by causing the remaining portion to pass through the second fragmentation module 128 and the mass spectrometer module 130 without further fragmentation or analysis. The method 200 then ends at step 295. Alternatively, the remaining portion can be discarded by steering the ion beam into an electrode within the storage/multiplex module 126 and/or the second fragmentation chamber 128.

Alternatively, steps 230 through 260 are repeated if the mass spectrometry data is indicative that another portion of the fragmented group F is to be selected. Criteria for such a decision can be preconfigured within the application 110 and/or made by a user of the system 100.

Hence, each of a plurality of portions of the fragmented group F are sequentially selected and fragmented prior to mass spectrometry analysis. Further, each of a plurality of portions of the fragmented group F are analyzed via mass spectrometry, once each of the plurality of portions of the fragmented group F has been fragmented.

Returning to step 260, if the fragmented group is depleted, at step 270 it is determined if more ions from the ion source are to be produced, filtered etc. If so, then steps 210 through 290 are repeated, as described above, once further ions are produced at the ion source, for example by introducing a further sample for mass spectrometry analysis, and filtered at the filtering module 101. If not, the method 200 ends at step 295.

Figure 7:
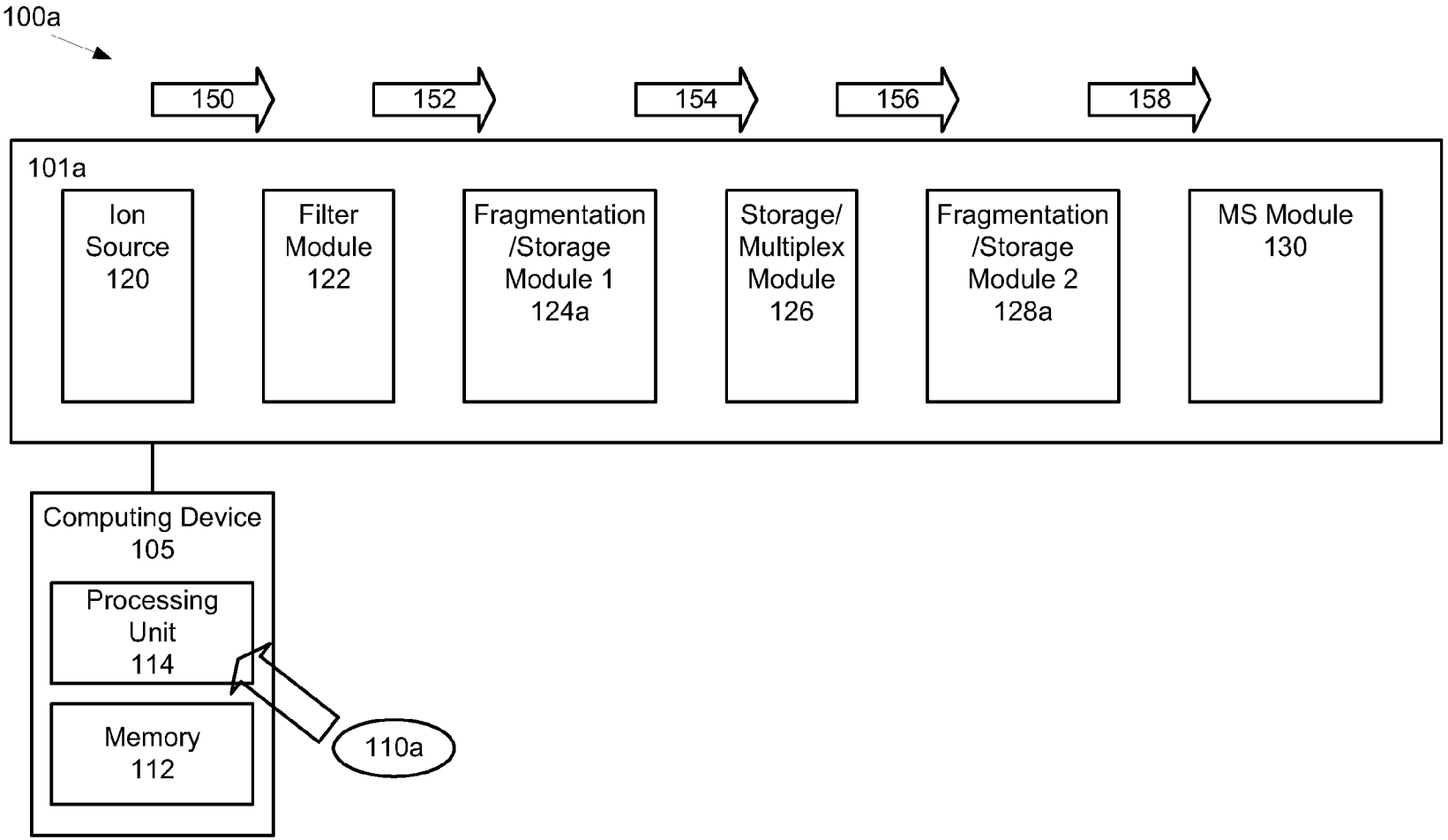
FIGS. 7 to 11 depict systems for multiplexing ions in MSn mass spectrometry analysis, according to non-limiting embodiments.

Attention is now directed to FIG. 7, which depicts a system 100*a* for multiplexing ions in MSn mass spectrometry analysis, according to non-limiting embodiments. System 100*a* is substantially similar to the system 100, with like elements having like numbers. The system 100*a* comprises a mass spectrometer 101*a*, which is substantially similar to the mass spectrometer 101 however each fragmentation module, including a first fragmentation/storage module 124*a* and a second fragmentation/storage module 128*a* are enabled to store ions and/or fragmented ions. Hence, each of the first fragmentation/storage module 124*a* and second fragmentation/storage module 128*a* are functionally enabled in manner similar to the first fragmentation module 124 and the second fragmentation module 128, respectively, as well as the storage/multiplex module 126. This enables the mass spectrometer 101*a* to perform the method 200 as described above, and while the fragmented portion F is being stored in the storage module, further ions can be fragmented to produce a second fragmented group, the second fragmented group stored in the first fragmentation/storage module 124*a* independent of the fragmented group F while the fragmented group F is being sequentially selected, fragmented and analyzed via mass spectrometry, such that the second fragmented group can be later sequentially selected, fragmented and analyzed via mass spectrometry, for example after the fragmented group F is depleted or discarded.

This further enables ions and/or fragmented ions to be stored in any of the first fragmentation/storage module 124*a*, the storage/multiplex module 126, and the second fragmentation/storage module 128*a* while fragmentation and/or analysis is taking place in another of the elements of the mass spectrometer 101*a*. Such storage and fragmentation etc., can be controlled via an application 110*a* upon processing by the processing module 114. The application 110*a* is substantially similar to the application 110, however the application 110*a* is further enabled to cause the mass spectrometer 101*a* to perform concurrent fragmentation/storage in a plurality of the elements of the mass spectrometer 101*a*.

Figure 8:
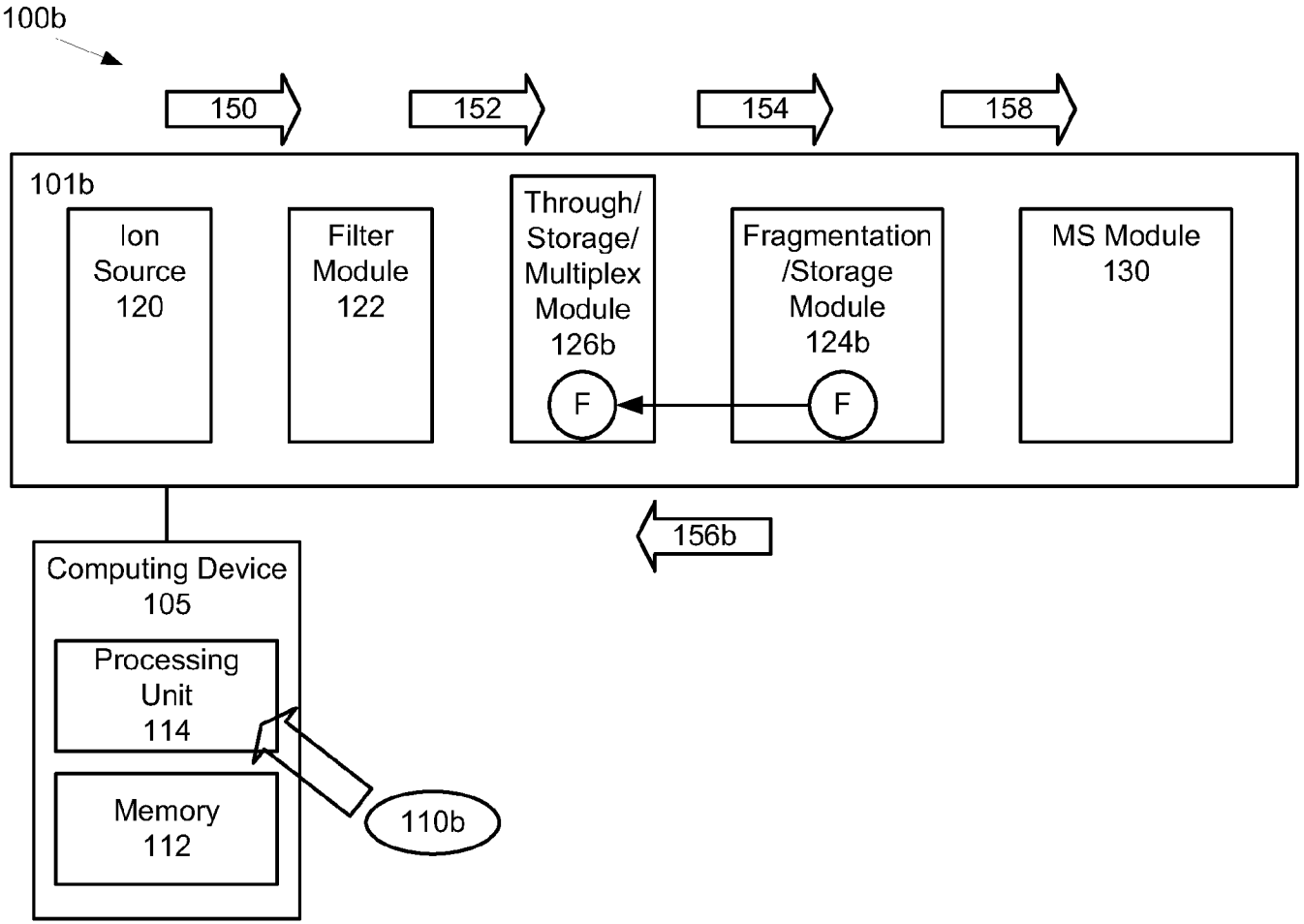

Attention is now directed to FIG. 8, which depicts a system 100*b* for multiplexing ions in MSn mass spectrometry analysis, according to non-limiting embodiments. System 100*b* is substantially similar to the system 100, with like elements having like numbers. The system 100*b* comprises a mass spectrometer 101*b*, which is similar to the mass spectrometer 101*a*, but comprises only one fragmentation/storage module 124*b*, similar to the first fragmentation/storage module 124*a*, and a through/storage/multiplex module 126*b* located between the filter module 122 and the fragmentation/storage module 124*b*. The through/storage/multiplex module 126*b* is enabled to store ions and/or fragmented ions similar to the storage/multiplex module 126, as described above (including sequential selective transfer of ions stored therein), however the through/storage/multiplex module 126*b* is further enabled to allow ions from the filter module 122 to pass through to the fragmentation/storage chamber 124*b* for fragmentation.

Figure 9:
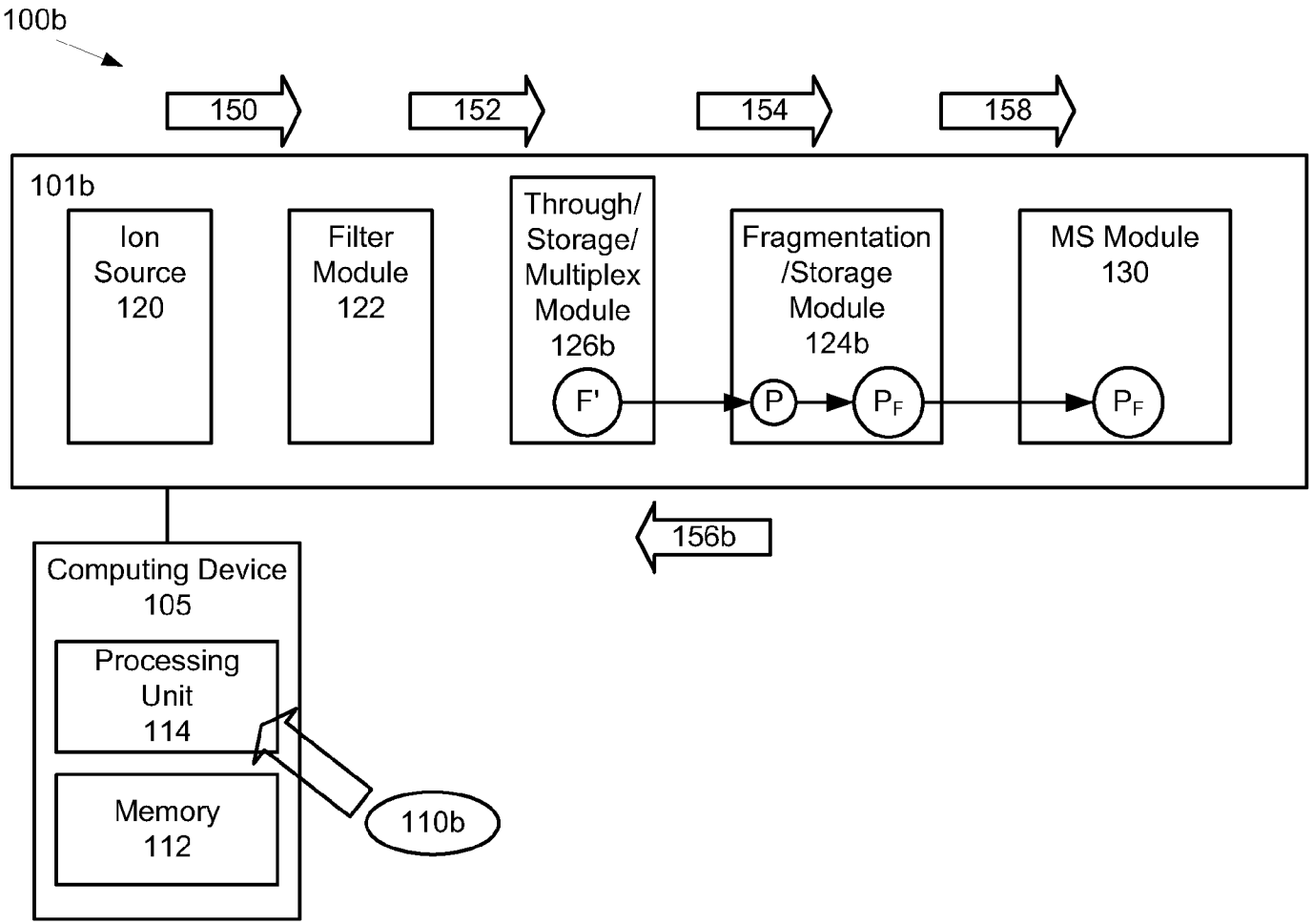

The method 200 can be performed using the system 100*b*, with the following differences. At step 210 the ions from the ion source are fragmented in the fragmentation/storage module 124*b* to form the fragmented group F. $MS^2$ analysis can be performed at this stage. However, the fragmented group F can also be transferred (arrow 156*b*) back towards the ion source 120 (i.e. back along an ion path of the mass spectrometer 101*b*) to the through/storage/multiplex module 126*b*, for storage at step 220, as in FIG. 8. As depicted in FIG. 9 (which is substantially similar to FIG. 8, with like elements having like numbers), at step 230 the portion P of the fragmented group is selected and transferred back to the fragmentation/storage chamber 124*b*, where it is fragmented at step 240 (producing the fragmented portion $P_F$) and transferred to the mass spectrometer module 130 for $MS^3$ analysis.

If additional fragmentation is desired ($MS^n$, n>3), the fragmented group F can be transferred back and forth between the through/storage/multiplex module 126*b* and the fragmentation/storage module 124*b* as many times as is required to achieve the desired degree of fragmentation. For example, the selecting step 230 and fragmenting step 240 are repeated a given number of times for each of the plurality of portions P of the fragmented group F prior to the analyzing step 250, such that at least a subset of each of the plurality of portions P of the fragmented group F is re-fragmented the given number of times. Hence, the selecting and step 230 and the fragmenting step 240 comprise causing at least a subset of each of the plurality of portions P to travel back and forth along an ion path of the mass spectrometer 101*b*.

This geometry generally reduces the number of components in the mass spectrometer 101*b*, relative to the mass spectrometer 101 or the mass spectrometer 101*a*, by using only one fragmentation chamber and enabling transfer of ions back through the mass spectrometer 101*b* to enable $MS^n$. Further, the transfer and storage of ions and fragmented ions, can be controlled via an application 110*b* upon processing by the processing module 114. The application 110*b* is substantially similar to the application 110, however the application 110*b* is further enabled to cause the mass spectrometer 101*a* to perform concurrent fragmentation/storage in a plurality of the elements of the mass spectrometer 101*a*.

Figure 10:
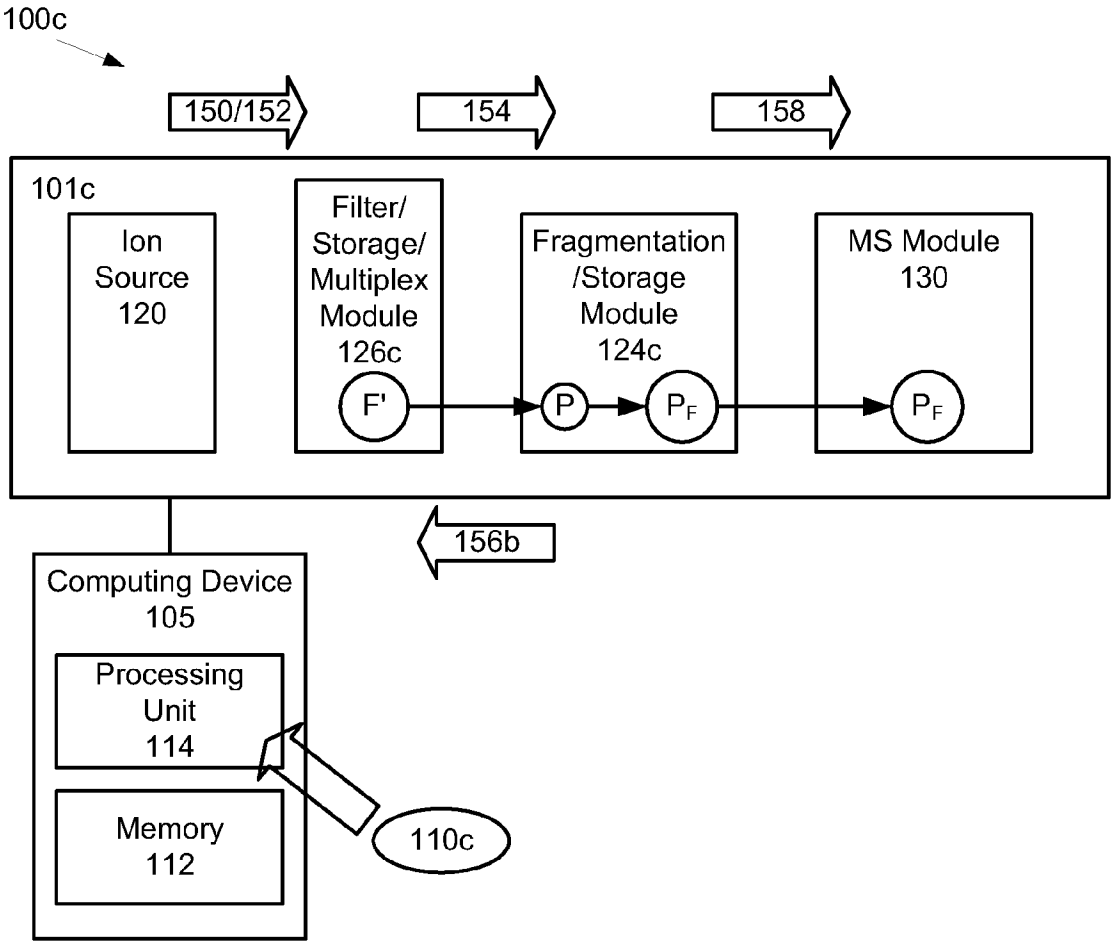

Attention is now directed to FIG. 10, which depicts a system 100*c* for multiplexing ions in MSn mass spectrometry analysis, according to non-limiting embodiments. System 100*c* is substantially similar to the system 100*b*, with like elements having like numbers. The system 100*c* comprises a mass spectrometer 101*c*, which is similar to the mass spectrometer 101*b*, but comprises a combined filter/storage/multiplex module 126*c* between the ion source 120 and a fragmentation/storage module 124*c* (hence arrows 150 and 152 are combined). The fragmentation/storage module 124*c* is substantially similar to the fragmentation/storage module 124*b*. The filter/storage/multiplex module 126*c* performs substantially the same function as the filter module 122 and the through/storage/multiplex module 126*b* combined, further reducing the number of components in the mass spectrometer 101*c*, relative to the mass spectrometer 101 the mass spectrometer 101*a*, and the mass spectrometer 101*b* by enabling filtering and storage in a single component. As in the mass spectrometer 101*b*, the fragmented group F is transferred (arrow 156*b*) back towards the ion source 120 for storage and sequential selection in the filter/storage/multiplex module 126*c*. Further, the transfer and storage of ions and fragmented ions, can be controlled via an application 110*c* upon processing by the processing module 114. The application 110*c* is substantially similar to the application 110*b*, however the application 110*b* is further enabled to cause the filter/storage/multiplex module 126*c* to filter and/or store as required.

Figure 11:
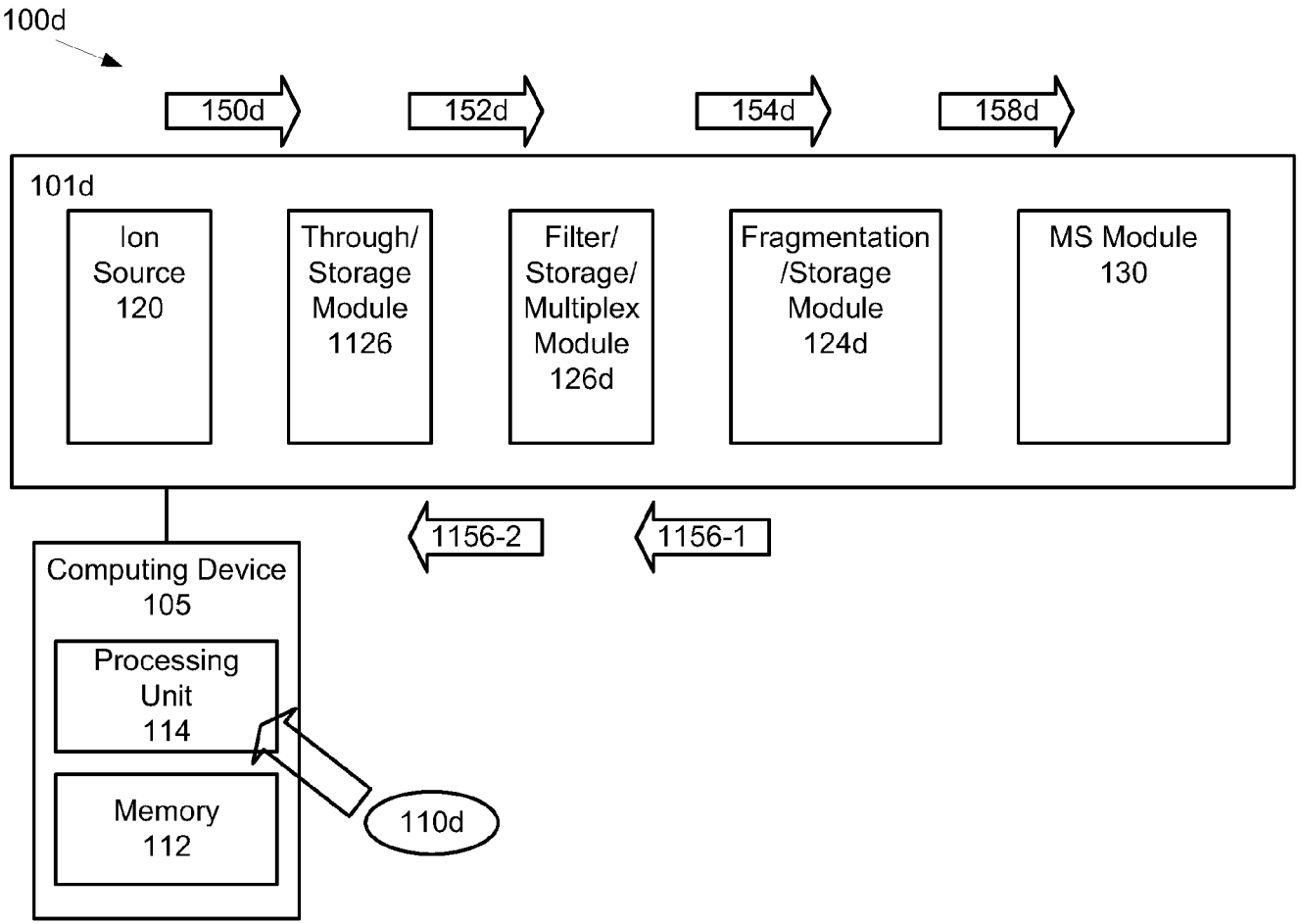

Attention is now directed to FIG. 11, which depicts a system 100*d* for multiplexing ions in MSn mass spectrometry analysis, according to non-limiting embodiments. System 100*d* is substantially similar to the system 100*c*, with like elements having like numbers. The system 100*d* comprises a mass spectrometer 101*d*, similar to the mass spectrometer 101*c*, however the mass spectrometer 101*d* comprises the ion source 120 connected to a through/storage module 1126, similar to the through storage/multiplex module 126*b*, which is in turn connected to a filter/storage/multiplex module 126*d*, similar to the filter/storage/multiplex module 126*c*. In some embodiments the through/storage module 1126 is enabled for sequential selection of ions stored therein. In other embodiments, the through/storage module 1126 is not enabled for sequential selection of ions stored therein. Rather, in these embodiments, the through/storage module 1126 is not enabled for non-selective transfer of ions stored therein to the filter storage/multiplex module 126.

The filter/storage/multiplex module 126*d* is in turn connected to a fragmentation/storage module 124*d*, similar to the fragmentation/storage module 124*c*, which is connected to the mass spectrometry module 130. Hence, the arrangement of the components in the mass spectrometer 101*d* is similar to the arrangement of the components in the mass spectrometer 101*c* with, however, the through/storage module 1126 located between the ion source 120 and the filter/storage/multiplex module 126*d*.

The mass spectrometer 101*d* is generally enabled to transfer ions and/or fragmented ions from the ion source 120 through the filter/storage/multiplex module 126*d* to filter ions, as described above, and the filtered ions are subsequently transferred to the fragmentation/storage module 124*d* (e.g. arrows 150*d*, 152*d*, 154*d* and 158*d*). The mass spectrometer 101*d* is further enabled to transfer ions and/or fragmented ions from the fragmentation/storage module 124*d* to the filter/storage module (arrow 1156-1) and from the filter/storage/multiplex module 126*d* to the through/storage module 1126 (arrow 1156-2) (i.e. back along the ion path). Further, each of the through/storage module 1126, the filter/storage/ multiplex module 126*d* and the fragmentation/storage module 124*d* is enabled to store ions and/or fragmented ions. This enables the mass spectrometer 101*d* to store ions and/or fragmented ions in each of the each of the through/storage module 1126, the filter/storage/multiplex module 126*d* and the fragmentation/storage module 124*d* while further fragmentation and/or mass spectrometry analysis is occurring in another element of the mass spectrometer 101*d*. Hence, ions and/or fragmented ions can be stored in the through/storage module 1126 and/or the filter/storage/multiplex module 126*d* while fragmentation and analysis is occurring in the fragmentation/storage module 124*d* and the mass spectrometry module 130, respectively. Further, fragmented ions can be stored in the fragmentation/storage module 124*d* while analysis is occurring in the mass spectrometry module 130. The transfer and storage of ions and fragmented ions, can be controlled via an application 110*d* upon processing by the processing module 114. The application 110*d* is substantially similar to the application 110*b*, however the application 110*d* is further enabled to cause the through/storage module 1126 to allow ions to pass through and/or store as required.

Figure 15:
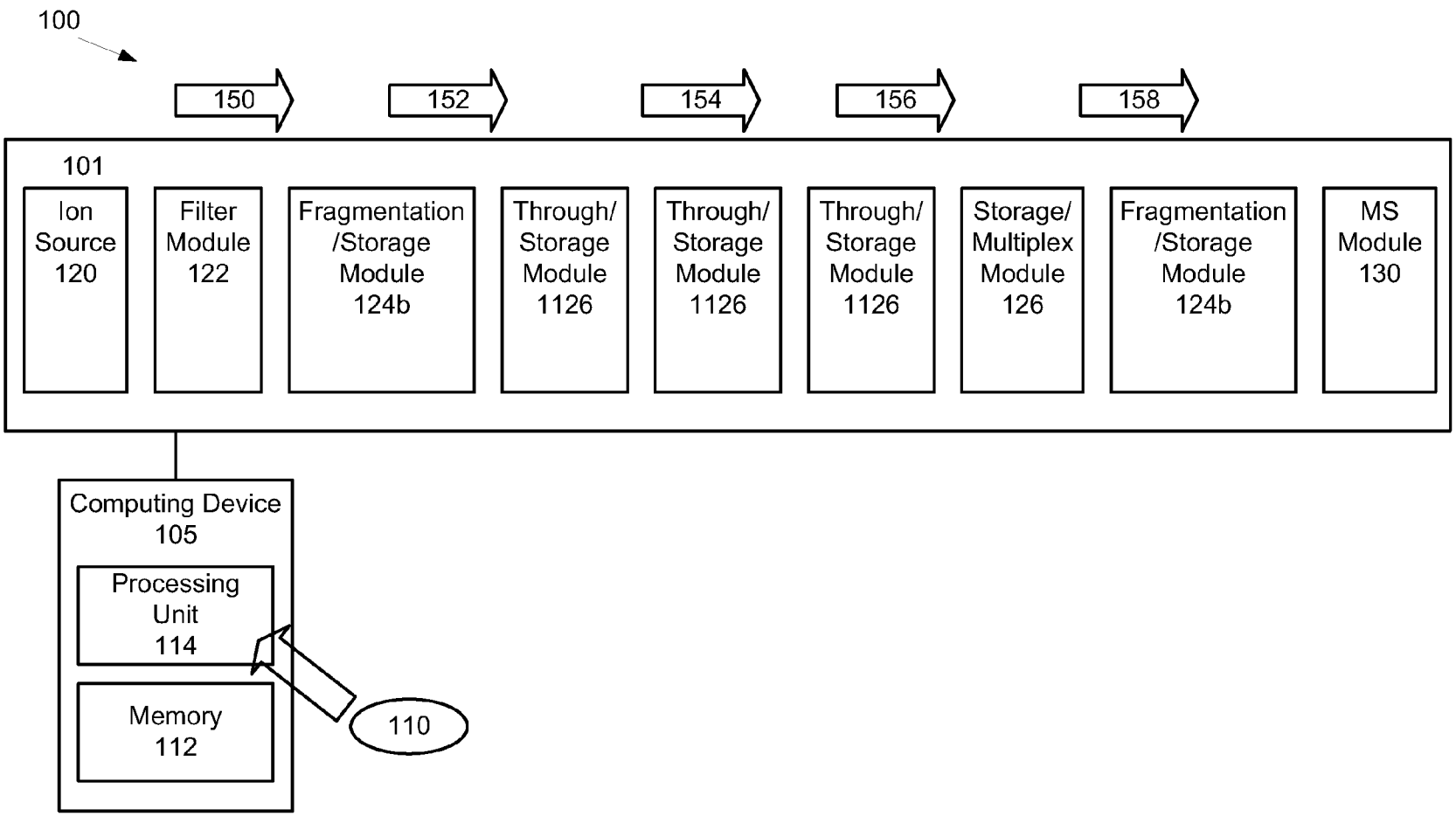
FIG. 15 depicts a system for multiplexing ions in MSn mass spectrometry analysis, according to non-limiting embodiments.

Attention is now directed to FIG. 15, which depicts a system 100*h* for multiplexing ions in MSn mass spectrometry analysis, according to non-limiting embodiments. System 100*h* is substantially similar to the system 100*a*, with like elements having like numbers, with a first fragmentation/storage module 124*h* and a second fragmentation/storage module 128*h* being substantially similar to the first fragmentation/storage module 124*a* and the second fragmentation/storage module 128*a*. respectively, and with a storage/multiplex module 126*h* being substantially similar to the storage/multiplex module 126. However, located between the first fragmentation/storage module 124*h* and the storage/multiplex module 126*h* are through/storage modules 1126*h*-1, 1126*h*-2, 1126*h*-3 (generically, a through/storage module 1126*h* and collectively through/storage modules 1126*h*), each through/storage module 1126*h* being substantially similar to the through/storage module 1126, described above. Furthermore, the mass spectrometer 101*h* is enabled to transfer ions along an ion path from the ion source 120 to the mass spectrometry module 130 (e.g. arrows 1500-1514), with ion transfer from the storage/multiplex module 126*h* to the second fragmentation module 128*h* occurring selectively (i.e. arrow 1512, sequential selection of ions). The mass spectrometer 101*h* is further enabled to transfer ions back along the ion path from the second fragmentation/storage chamber 128*h* to the through/storage module 1126*h*-1, in a non-selective manner (i.e. arrows 1516-1522), as desired. The transfer of ions between the modules (selective and non-selective), and storage of ions and fragmented ions, can be controlled via an application 110*h* upon processing by the processing module 114.

In general ions fragmented by the first fragmentation module 124*h* (e.g. ions for $MS^2$, or $MS^2$ ions) can be transferred to the storage/multiplex module 126*h*, via the through/storage modules 1126*h* (arrows 1504-1510), where selective transfer (arrow 1512) of fragmented ions to the second fragmentation/storage module 128*h* occurs. The remaining $MS^2$ ions can be transferred from the storage/multiplex module 126*h* back along the ion path to the through/storage module 1126*h*-1 (i.e. arrows 1518-1522) for storage. Once the ions selected from the $MS^2$ ions are fragmented in the second fragmentation/storage module 128*h* (i.e. $MS^3$ ions), they can be transferred back along the ion path to the through/storage module 1126*h*-2 (i.e. arrows 1516-1520). However, in doing so, the $MS^3$ ions can first be transferred back to storage/multiplex module 126*h* where yet another subset of ions can be selected and transferred back to the fragmentation/storage module 128*h* for yet further fragmentation (i.e. $MS^4$ ions are produced). The $MS^4$ ions can then be transferred back along the ion path to the through/storage module 1126*h*-3 (i.e. arrows 1516-1518) for storage. Each of the $MS^2$, $MS^3$, $MS^4$ ions are then stored in the through/storage modules 1126*h*-1, 1126*h*-2 and 1126*h*-3, respectively. Each in turn can be transferred back to the storage/multiplex module 126*h* for yet further sequential selection and/or fragmentation, as desired, starting with the $MS^4$ ions. Mass spectrometry analysis performed on each successive generation of fragmented ions can be used to inform how further mass spectrometry analysis can be performed on the earlier generations (i.e. $MS^4$ data can be used to determine how to process the remaining $MS^2$ and $MS^3$ ions, to create further branching generations). As through/storage modules, enabled for non-selective transfer, are generally more economical than storage/multiplex modules, a cost saving can be achieved over mass spectrometers with a plurality of storage/multiplex modules. Furthermore, it is understood that if storage of yet further generations of fragmented ions is desired (e.g. $MS^5$, $MS^6$ etc.), then further through/storage modules 1126*h* can be provided, such that a number X of through/storage modules 1126*h*, enables the mass spectrometer 101*h* to simultaneously store X+1 generations of fragmented ions.

Figure 12:
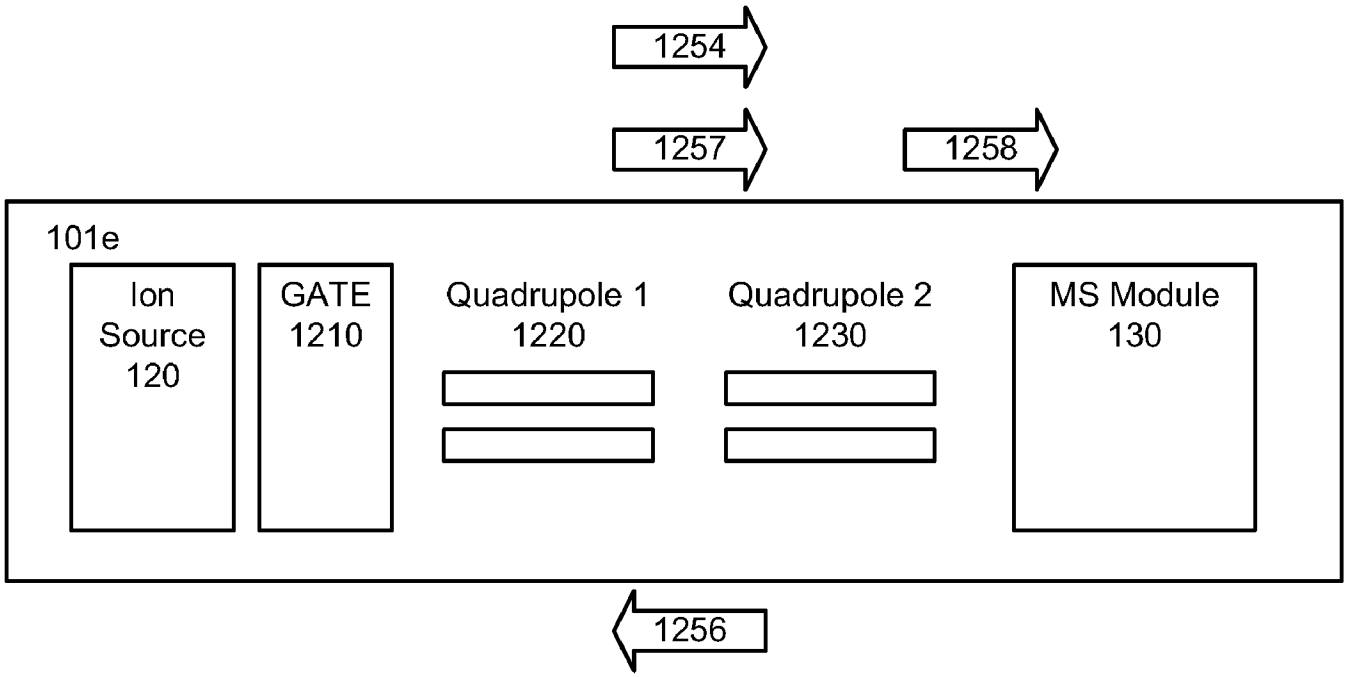
FIGS. 12 to 14 depict mass spectrometers for multiplexing ions in MSn mass spectrometry analysis, according to non-limiting embodiments.

Attention is now directed to FIG. 12, which depicts a mass spectrometer 101*e* for multiplexing ions in MSn mass spectrometry analysis, according to non-limiting embodiments. The mass spectrometer 101*e* is substantially similar to the mass spectrometer 101*c*, however ions are gated via a gate 1210 located after the ion source 120, and the functionality of the filter/storage/multiplex module 126 occurs via a first quadrupole 1220 and the functionality of the fragmentation/storage module 124*c* occurs via a second quadrupole 1230. Hence, ions can be transferred from the first quadrupole 1220 to the second quadrupole 1230 (arrow 1254) for fragmentation in the second quadrupole 1230, and transferred (arrow 1256) back to the first quadrupole 1220 for sequential selection and selective transfer back (arrow 1257) to the second quadrupole 1230 and fragmentation, before analysis in the mass spectrometry module 130 (arrow 1258).

Figure 13:
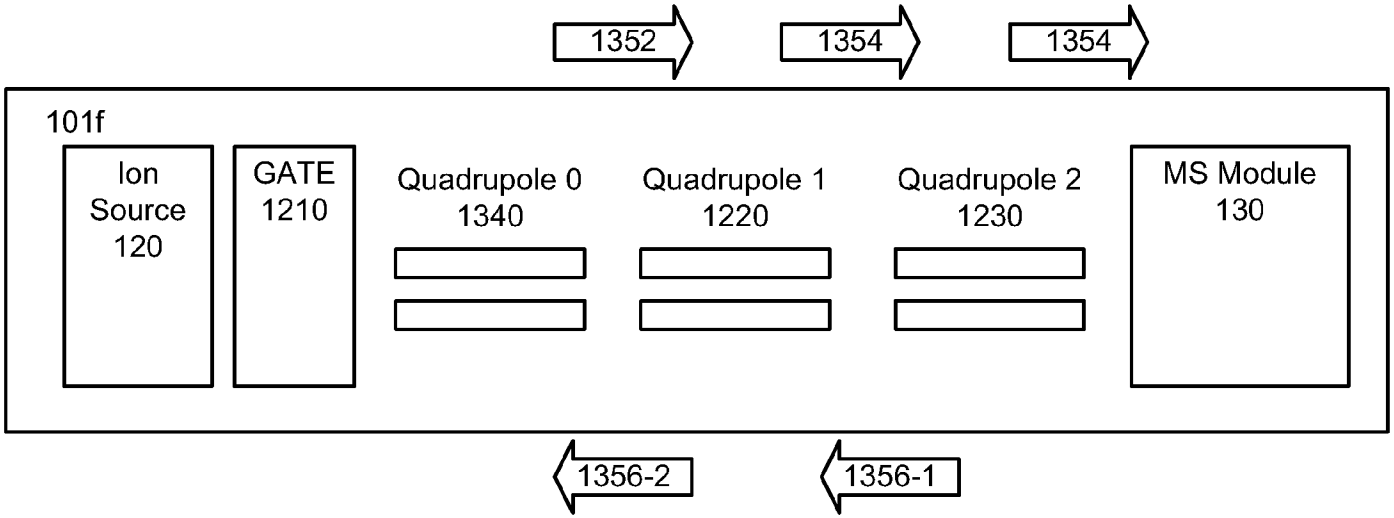

Attention is now directed to FIG. 13, which depicts a mass spectrometer 101*f* for multiplexing ions in MSn mass spectrometry analysis, according to non-limiting embodiments. The mass spectrometer 101*f* is substantially similar to the mass spectrometer 101*e*, however the mass spectrometer 101*f* comprises a third quadrupole 1340 (labelled "Quadrupole 0" in FIG. 13) located between the gate 1210 and the first quadrupole 1220. The third quadrupole 1340 is enabled with the same functionality as the through/store module 1126. From this perspective, the mass spectrometer 101*f* is also substantially similar to the mass spectrometer 101*d*, with similar functionality. Hence, ions can be transferred from the third quadrupole 1324 to the first quadrupole 1220 (arrow 1352), and from the first quadrupole 1220 to the second quadrupole 1230 (arrow 1354) for fragmentation in the second quadrupole 1230. Ions can also be transferred (arrow 1356-1) back to the first quadrupole 1220 for sequential selection and selective transfer back to the second quadrupole 1230, for further fragmentation, before analysis in the mass spectrometry module 130. Ions can also be transferred (arrow 1356-2) from the first quadrupole 1220 back to the quadrupole 1340, for storage while storage and/or fragmentation of other ions and other fragmented ions is occurring in other components of the mass spectrometer 101*f*.

Figure 14:
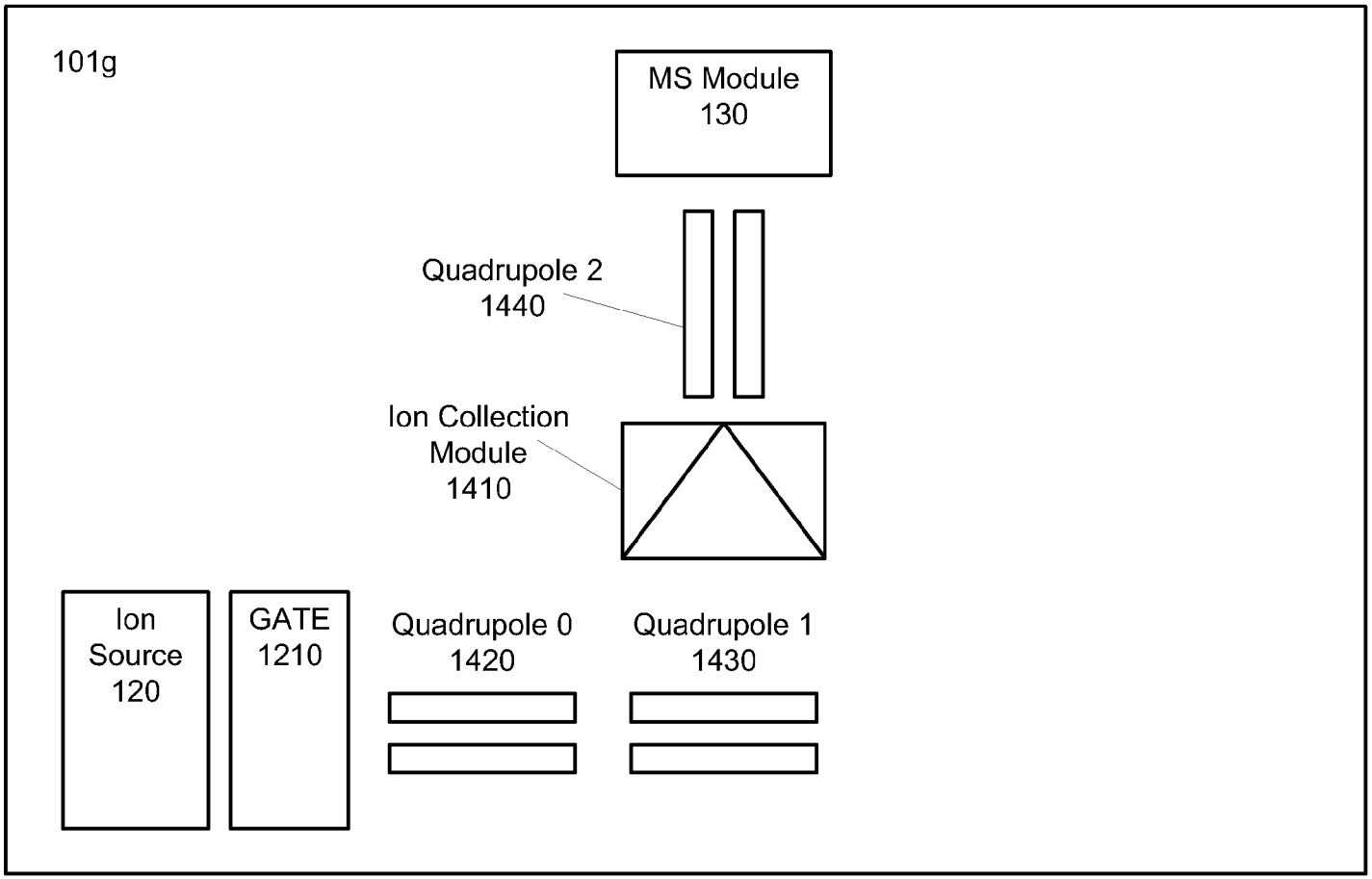

Attention is now directed to FIG. 14, which depicts a mass spectrometer 101*g* for multiplexing ions in MSn mass spectrometry analysis, according to non-limiting embodiments. The mass spectrometer 101*g* comprises the ion source 120, the gate 1210 and the mass spectrometry module 130, and three quadrupoles, described below, similar to the mass spectrometer 101*f*, as well as an ion collection module 1410, also described below. A quadrupole 1420 is connected to the gate 1210 and is enabled to transmit and store ions, similar to the through/store module 126*b*. A quadrupole 1430 is connected to the quadrupole 1420 and is enabled to filter, store and fragment ions, similar to a combination of the filter module 122, the storage/multiplex module 126 and the first fragmentation module 124. The quadrupole 1430 is further enabled to sequentially select and transfer portions of fragmented ions, produced and stored therein, to the ion collection module 1410 via radial ejection. The ion collection module 1410 is enabled to collect ions (i.e. fragmented ions) that have been sequentially selected and transferred from the quadrupole 1430 via radial ejection, and transfer the ions to a quadrupole 1440, which enables to quadrupole 1440 to be generally perpendicular to the quadrupole 1430. The quadrupole 1440 is enabled to fragment ions transferred from the ion collection module 1410 and transfer the fragmented ions to the mass spectrometry module 130 for analysis.

Any of mass spectrometers 101*e*-101*g* can be substituted into the systems 100-100*d* 100*h*, under control of a suitable application, similar to the application 110, as long as the suitable application is enabled to cause each component of the mass spectrometer to perform the desired functionality.

Those skilled in the art will appreciate that in some embodiments, the functionality of the applications 110-110*d*, and 110*h* can be implemented using pre-programmed hardware or firmware elements (e.g., application specific integrated circuits (ASICs), electrically erasable programmable read-only memories (EEPROMs), etc.), or other related components. In other embodiments, the functionality of the applications 110-110*d*, and 110*h* can be achieved using a computing apparatus that has access to a code memory (not shown) which stores computer-readable program code for operation of the computing apparatus. The computer-readable program code could be stored on a computer readable storage medium which is fixed, tangible and readable directly by these components, (e.g., removable diskette, CD-ROM, ROM, fixed disk, USB drive). Alternatively, the computer-readable program code could be stored remotely but transmittable to these components via a modem or other interface device connected to a network (including, without limitation, the Internet) over a transmission medium. The transmission medium can be either a non-wireless medium (e.g., optical and/or digital and/or analog communications lines) or a wireless medium (e.g., microwave, infrared, free-space optical or other transmission schemes) or a combination thereof.

The section headings used herein are for organizational purposes only and are not to be construed as limiting the subject matter in any way.

Persons skilled in the art will appreciate that there are yet more alternative implementations and modifications possible for implementing the embodiments, and that the above implementations and examples are only illustrations of one or more embodiments. Furthermore, while the applicant's teachings are described in conjunction with various embodiments, it is not intended that the applicant's teachings be limited to various embodiments. On the contrary, the applicant's teachings encompass various alternatives, modifications, and equivalents, as will be appreciated by those with skill in the art.

What is claimed is:

1. A method for multiplexing ions in an $MS^n$ mass spectrometer, comprising, filtering ions to produce a group of ions of interest, said group of ions below a space charge limit of said $MS^n$ mass spectrometer;

fragmenting at least a portion of said group of ions to form a fragmented group of ions;

storing said at least a portion of said fragmented group such that a plurality of portions of said fragmented group can be sequentially selected for mass spectrometry analysis;

sequentially selecting and re-fragmenting each of said plurality of portions of said fragmented group prior to said mass spectrometry analysis; and analyzing, via mass spectrometry, each of said plurality of portions of said fragmented group once each of said plurality of portions of said fragmented group has been fragmented.

2. The method of claim 1, further comprising repeating said storing step and said sequentially selecting and re-fragmenting step a given number of times for each of said plurality of portions of said fragmented group prior to said analyzing step, such that at least a subset of each of said plurality of portions of said fragmented group is re-fragmented said given number of times.

3. The method of claim 1, wherein said storing step comprises causing said fragmented group to travel back along an ion path of the $MS^n$ mass spectrometer.

4. The method of claim 1, wherein said sequentially selecting and re-fragmenting steps comprises causing at least a subset of each of said plurality of portions of said ions to travel back and forth along an ion path of the mass spectrometer.

5. The method of claim 1, wherein said sequentially selecting and re-fragmenting steps comprises selectively transferring at least a subset of each of said plurality of portions of said fragmented group through the $MS^n$ mass spectrometer, wherein said selective transferring comprises selecting a given mass range of each of said plurality of portions of said fragmented group.

6. The method of claim 1, wherein filtering ions to produce a group of ions of interest comprises filtering said ions based on a given mass range of said ions.

7. A multiplexing $MS^n$ mass spectrometer, comprising, an ion source for producing ions;

a filter module, connected to said ion source, for filtering said ions to produce a group of ions of interest, said group of ions below a space charge limit of said $MS^n$ mass spectrometer;

a storage module, connected to said filter module, for storing at least said group of ions of interest, said at least one storage module further enabled to sequentially select a plurality of portions of at least said group of ions of interest for fragmentation and mass spectrometry analysis;

a fragmentation module, connected to said storage module, for fragmenting ions which have been sequentially selected at said at least one storage module; and a mass spectrometry analysis module, connected to said fragmentation module, for analyzing fragmented ions, via mass spectrometry.

8. The multiplexing $MS^n$ mass spectrometer of claim 7, wherein said storage module and said fragmentation module are enabled to transfer at least a subset of each of said plurality of portions back and forth between each of said storage module and said fragmentation module a given number of times such that at least each said subset is fragmented said given number of times prior to analysis by said mass spectrometry analysis module.

9. The multiplexing MS$^n$ mass spectrometer of claim 8, wherein transfer of at least each said subset from said fragmentation module to said storage module occurs non-selectively, and transfer of at least each said subset from said storage module to said fragmentation module occurs selectively.

10. The multiplexing MS$^n$ mass spectrometer of claim 8, wherein said storage module is further enabled for said group of ions of interest to pass there-through to said fragmentation module.

11. The multiplexing MS$^n$ mass spectrometer of claim 8, wherein said at least one storage module comprises said filtering module.

12. The multiplexing MS$^n$ mass spectrometer of claim 11, further comprising a second storage module located between said ion source and said storage module, said second storage module enabled for ion storage and sequential selection of a plurality of portions of a group of ions stored therein for fragmentation and mass spectrometry analysis.

13. The multiplexing mass spectrometer of claim 12, wherein said second storage module is further enabled to allow ions from said ion source to pass there-through to said storage module.

14. The multiplexing MS$^n$ mass spectrometer of claim 13, wherein said second storage module and said storage module are enabled to transfer ions stored in said storage module to said second storage module.

15. The multiplexing MS$^n$ mass spectrometer of claim 7, wherein said fragmentation module is further enabled to store said fragmented ions.

16. The multiplexing MS$^n$ mass spectrometer of claim 7, wherein at least one of said storage module and said fragmentation module are enabled to discard a remaining portion of ions located therein.

17. The multiplexing MS$^n$ mass spectrometer of claim 7, further comprising a second fragmentation module located between said storage module and said second fragmentation module for fragmenting said group of ions of interest prior to storing said group of ions of interest in said storage module.

18. The multiplexing MS$^n$ mass spectrometer of claim 7, further comprising a given number of through/storage modules located between said second fragmentation module and said storage module, each said through/storage module enabled to store a given generation of fragmented ions, and each said through/storage module enabled for non-selective transfer of ions there-through to said storage module, and further enabled for non-selective transfer of ions from said storage module to said second fragmentation chamber.

19. The multiplexing MS$^n$ mass spectrometer of claim 7, wherein said ion source comprises at least one of an electrospray ion source, a nano-spray ion source, an APCI (atmospheric pressure chemical ionization) ion source, an APPI (atmospheric pressure photoionization) ion source, an electron impact ion source, a MALDI (matrix assisted laser desorption ionization) ion source and a SIMS (secondary ion mass spectrometry) ion source.

20. The multiplexing MS$^n$ mass spectrometer of claim 7, wherein said fragmentation module comprises at least one of collision induced dissociation (CID), surface induced dissociation (SID), electron capture dissociation (ECD), electron transfer dissociation (ETD), metastable-atom bombardment, and photo-fragmentation.

21. The multiplexing MS$^n$ mass spectrometer of claim 7, wherein said storage module comprises at least one of a linear ion trap, an array of linear ion traps, an array of 3D ion traps, a Penning trap, a quadrupole ion trap, a cylindrical ion trap, an ion trap with axial ejection, an ion trap with radial ejection, a Time-of-Flight separation system and a mobility separation ion trap.

22. The multiplexing mass spectrometer of claim 7, wherein said mass spectrometry analysis module comprises at least one of a sector field mass analyzer, a time of flight analyzer, a quadrupole mass analyzer, an ion trap, a quadrupole ion trap, a linear quadrupole ion trap, a quadrupole mass filter, a TOF (time of flight) analyzer, and a FT-MS (Fourier transform mass spectrometry mass) analyzer.

23. The multiplexing mass spectrometer of claim 7, wherein said filter module comprises at least one of a quadrupole mass filter, a magnetic sector mass filter, an ion mobility filter, and an ion trap mass filter.

* * * * *